United States Patent [19]

Langner

[11] Patent Number: 4,541,753

[45] Date of Patent: Sep. 17, 1985

[54] SUBSEA PIPELINE CONNECTION

[75] Inventor: Carl G. Langner, Spring, Tex.

[73] Assignee: Shell Oil Company, Houston, Tex.

[21] Appl. No.: 516,086

[22] Filed: Jul. 22, 1983

[51] Int. Cl.[3] ..... F16L 1/04

[52] U.S. Cl. ..... 405/166; 405/169

[58] Field of Search ..... 405/158, 166, 168, 169, 405/170; 166/338, 341, 344

[56] References Cited

U.S. PATENT DOCUMENTS

| | | | |
|---|---|---|---|
| 3,373,807 | 3/1968 | Fischer et al. | 405/169 X |
| 3,724,061 | 4/1973 | Schipper | 405/169 X |
| 4,041,719 | 8/1977 | Baugh | 405/169 |
| 4,120,171 | 10/1978 | Chateau et al. | 405/169 |
| 4,277,202 | 7/1981 | Archambaud et al. | 405/169 |

*Primary Examiner*—David H. Corbin

[57] ABSTRACT

A method and apparatus are provided for connecting an offshore pipeline or flowline bundle to a deepwater subsea structure and then laying away from said structure. The pipeline or flowline bundle is deployed vertically from a pipelay vessel to make a hinged connection with the subsea structure. The connection operation is facilitated by a flowline connection tool attached to the pipeline or flowline bundle and designed to be inserted into a funnel located either centrally or to one side of the subsea structure. The connection procedure consists of landing and securing the flowline connection tool onto the subsea structure, then hinging over and connecting the pipeline or flowline bundle to the subsea structure as the pipeline or flowline bundle is laid on the seafloor beginning at the subsea structure.

6 Claims, 3 Drawing Figures

CENTRAL STAB AND HINGEOVER

SIDE STAB AND HINGEOVER

SUBSEA PIPELINE CONNECTION

BACKGROUND OF THE INVENTION

Connecting a pipeline or flowline bundle to a subsea production facility can be a very arduous and time consuming procedure, particularly in deep water. Depending upon the connection technique employed, if the pipeline is laid outside a specific target area, literally months can be spent correcting the error. This is not hard to understand once it is appreciated that the pipeline may be hundreds or even thousands of feet below the pipelay vessel, relatively immobile, and difficult to remotely manipulate. One method for approaching this problem is the so-called lateral deflection technique covered by U.S. Pat. No. 4,145,909. In accordance with that technique, a pipeline is deliberately laid to one side of and somewhat past the subsea production facility, and subsequently the pipeline is bent or deflected to make connection with the facility. This technique, while operable, nonetheless suffers from several drawbacks. First, the pipe ends must be laid down into a rather small target area and a means of pulling the pipe end toward the subsea production facility must be established. Second, the lateral deflection technique is at the mercy of unpredictable soil behavior as the pipeline must be pulled across often treacherous terrain as it sweeps toward the subsea production facility. Thus, the approach angle of the pipeline to the production facility is often unpredictable because of boulders or other obstacles which disrupt the motion of the pipeline as it is deflected toward the production facility. This latter problem may be overcome to some extent by cleaning the area over which the pipeline is to be deflected or by supporting the pipe off-bottom with a system of buoys and chains as described in U.S. Pat. No. 4,145,909. The lateral deflection technique has the further disadvantage that the area swept out by the pipe as it is deflected toward the subsea facility is large and this area is then unavailable for the installation of other equipment. A related drawback resides in the stresses introduced into the pipeline not only because of boulders and other obstacles in the path of deflection which, in an extreme case, may buckle the pipeline but also in the backward and lateral pulling on the pipeline necessary to deflect it toward the production facility. Even further, the lateral deflection technique is unduly complicated, requiring one or more tow vessels, as well as a drilling vessel to (1) land a pull-in tool onto a large sled at the end of the pipeline, (2) establish a connection between the sled and a pullcable carried by the pull-in tool, (3) pay out the pullcable between the sled and the production facility, (4) land the pull-in tool on the production facility, and finally (5) perform the deflection and pull-in operations.

Applicant is not aware of any other prior art which, in his judgment as one skilled in the pipeline art, would anticipate or render obvious this novel pipelay technique of the present invention; however, for the purposes of fully developing the background of the invention and establishing the state of the requisite art, the following art is set forth: U.S. Pat. No. 3,431,739.

SUMMARY OF THE INVENTION

The primary purpose of the present invention is to provide a method and apparatus for connecting and laying an offshore pipeline or flowline bundle from a subsea structure, which method and apparatus are relatively simple and economical to use and which do not subject the pipeline or flowline bundle to dangerous stresses. Preferably, the pipeline or flowline bundle is deployed vertically from a surface craft, making a hinged connection with the subsea structure, and then this hinged connection is "hinged over" from vertical to horizontal as the surface craft moves away from overhead the structure and begins pipelaying. Even more preferably, a flowline receiving means is provided on the subsea structure which is a funnel centrally located on the structure or a funnel located to one side of the structure. Most preferably, the hinged connection is made with a flowline connection tool attached to the flowline and designed to be inserted into the funnel. If the funnel is centrally located on the structure, it may be necessary to remove the flowline connection tool prior to inserting other apparatus on the structure, such as a christmas tree on a wellhead or a valve module on a multi-well template. When the funnel is located to one side of the structure, it is feasible to leave the flowline connection tool in place without interfering with apparatus which may subsequently be placed on top of the structure.

The primary distinctions of the present invention over the most relevant prior art reside in (1) the landing of the flowline connection tool onto the subsea structure, followed immediately by hingeover and pipelay in a single continuous operation, and (2) in the use of a vertical pipelay technique, both for making the connection with the subsea structure and for pipelay, which technique is simple and completely reversible at any time. The second feature, wherein the pipeline or flowline bundle is vertically laid, substantially eliminates the dangerous stresses on the pipeline or flowline bundle which occur in the relevant prior art processes.

Other purposes, distinctions over the existing art, advantages and features of the invention will be apparent to one skilled in the art upon review of the following.

DESCRIPTION OF A PREFERRED EMBODIMENT

Figure 1:
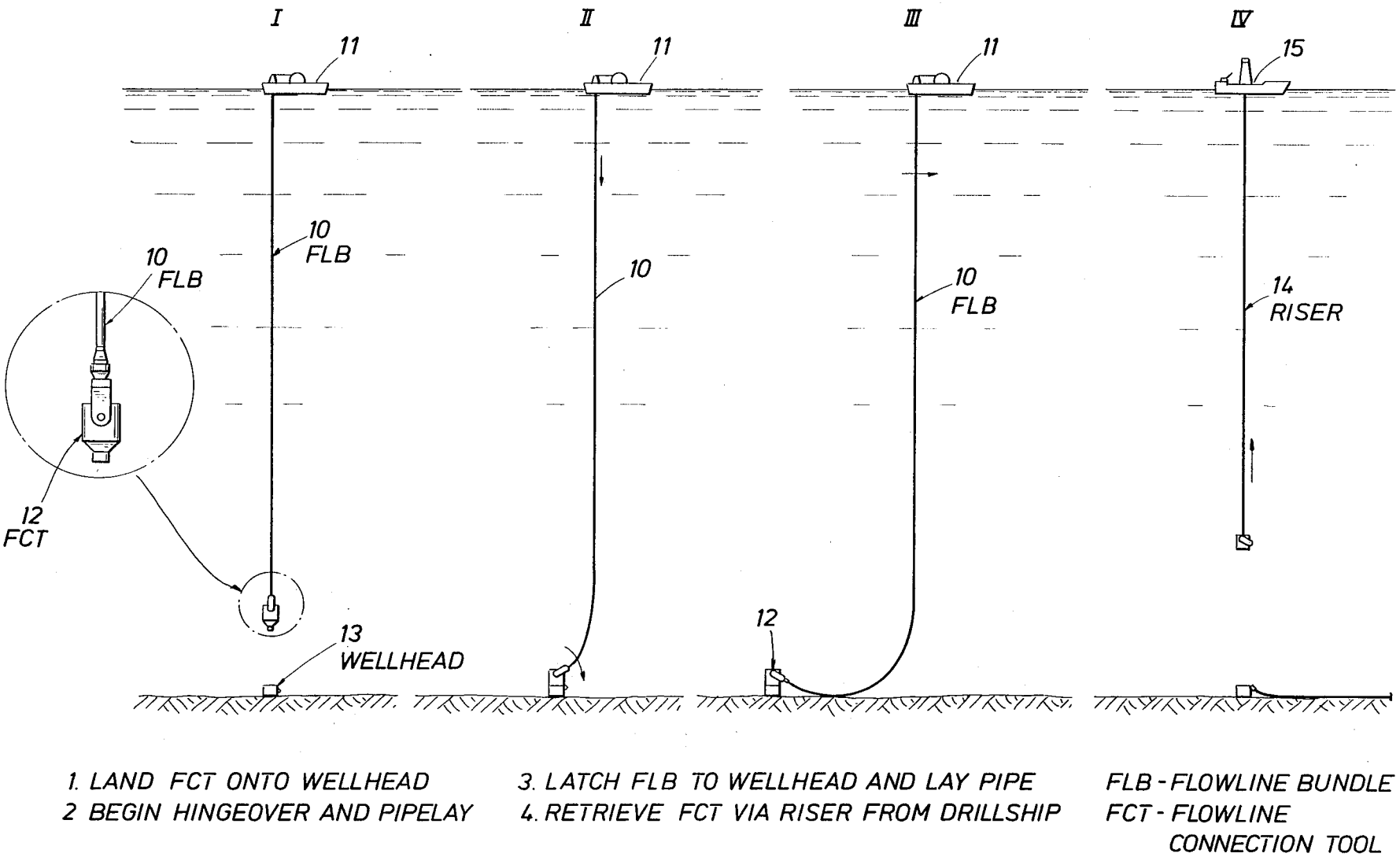
FIG. 1 shows the basic procedure of the invention for connecting a flowline to a subsea structure, including stabbing the flowline connection tool onto the subsea structure, hinging over, and beginning to lay the pipeline or flowline bundle away from the subsea structure.

The present invention is relevant to embodiments wherein an offshore pipeline or flowline bundle (both "pipeline" and "flowline bundle" hereinafter being termed "flowline") is deployed essentially vertically to a subsea structure such as a production facility which may be an individual subsea wellhead, a multi-well subsea template, an underwater manifold center, a tension leg platform base structure, etc. This invention pertains in particular to a method and apparatus for connecting the flowline to the subsea production facility. During the connection operation, the apparatus to be used with a pipelay vessel (as used hereinafter, "pipelay vessel" will include all "surface craft" suitable for pipelaying) will typically include a flowline, a flowline connection tool, and a flowline receiving means. The flowline receiver is a part of the subsea structure which is deployed either centrally or to one side of the structure to receive the flowline connection tool. The flowline connection tool is deployed at the end of the flowline and contains mechanisms for latching to the flowline receiver and to permit hingeover of the flowline from vertical to horizontal orientation.

The connection of the flowline to the subsea structure is accomplished by first deploying the flowline essentially vertically down to the subsea production facility. Preferably, the flowline has a flowline connection tool at the end thereof which is capable of engaging with the subsea structure in a manner to be more particularly described hereinafter. Once the flowline connection tool is landed and secured onto the subsea structure, the hingeover of the flowline begins, followed by latching the flowline to the subsea structure, and then laying flowline away from the structure. Finally, the flowline connection tool may be retrieved from the subsea structure via a riser from the pipelay vessel or some other surface vessel. In one embodiment of the invention, the central stab and hingeover concept, the flowline connection tool is landed centrally on the subsea structure prior to beginning the hingeover operation. In a second embodiment of the invenion, the side stab and hingeover concept, the flowline connection tool is landed to one side of the subsea structure before hingeover is accomplished. In this latter embodiment, it is not necessary to retrieve the flowline connection tool inasmuch as the flowline connection tool may be left in place without interfering with subsequent operation of the subsea structure, particularly as in the example of a wellhead wherein a christmas tree must be placed on the structure.

The present invention is especially advantageous in comparison with the prior art inasmuch as only one vessel is required to deploy and connect the flowline to the subsea structure. This should be compared to the aforementioned lateral deflection technique of the prior art wherein two or more vessels, including tugboats or pipelay vessel, drilling vessel, and other support vessels, may be employed. Also, since the present invention utilizes only one lay-down string, this minimizes potential tangling and eliminates other problems arising from the need to remotely connect a pullcable onto the end of the pipeline. Further, the present invention features the connection and laying of the pipeline without having to pull the pipeline to the subsea structure. This avoids problems with misalignment, high bending stresses, and large pull-in forces. In addition, the present invention facilitates the laying of a slack loop near the subsea structure, thus avoiding problems with thermal expansion, soil movements, etc.

Having thus generally described the apparatus and method of the present invention, as well as its numerous advantages over the most relevant prior art, the following is a more detailed description thereof given in accordance with specific reference to the drawings.

FIG. 1 shows by sequential stages a pipelay procedure wherein a flowline 10 is deployed essentially vertically from a pipelay vessel 11, stage I. In the detail shown in relation to stage I, a flowline connection tool 12 is connected to the end of the flowline bundle, and deployment is conducted by carefully positioning the pipelay vessel above the subsea structure 13 so that the flowline connection tool is landed onto the subsea structure and connection is made thereto. In state II of FIG. 1, connection has been made with the subsea structure and hingeover of the flowline 10 is begun, as shown by the direction of the arrow. In stage III, the hingeover process is complete, with the flowline latched to the subsea structure, and the laying of the flowline away from the subsea structure is underway. Finally, in stage IV the flowline has been laid and the flowline connection tool is being retrieved, if necessary, by the use of a riser 14 from a second vessel 15.

Figure 2:
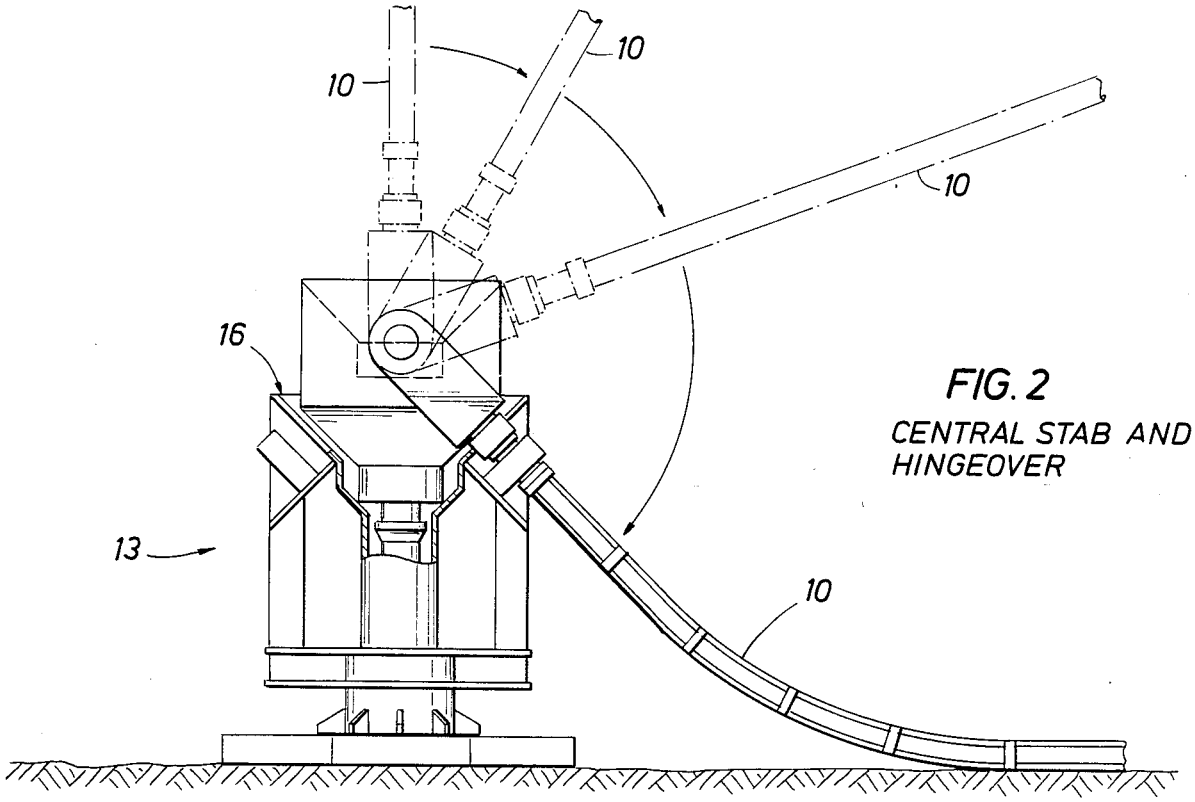
FIG. 2 shows a first embodiment of the invention for establishing connection between the flowline and the subsea structure and making a hinge-over. This is the central stab and hingeover technique.

FIG. 2 shows a first embodiment of a preferred apparatus for connecting the flowline 10 to the subsea structure 13. The sequential positioning of flowline 10 is shown in phantom in its initial three positions and in its final position on the sea floor. This embodiment is characterized as a central stab and hingeover technique. Thus, the flowline receiver 16 is deployed centrally on the subsea structure so that the flowline connection tool lands on top of the subsea structure prior to hingeover of the flowline 10. The flowline receiver 16 has a funnel shape which mates with the shape of the flowline connection tool and still allows for some inaccuracy of placement as the funnel guides the narrow lower part of the flowline connection tool into connection with the subsea structure.

Figure 3:
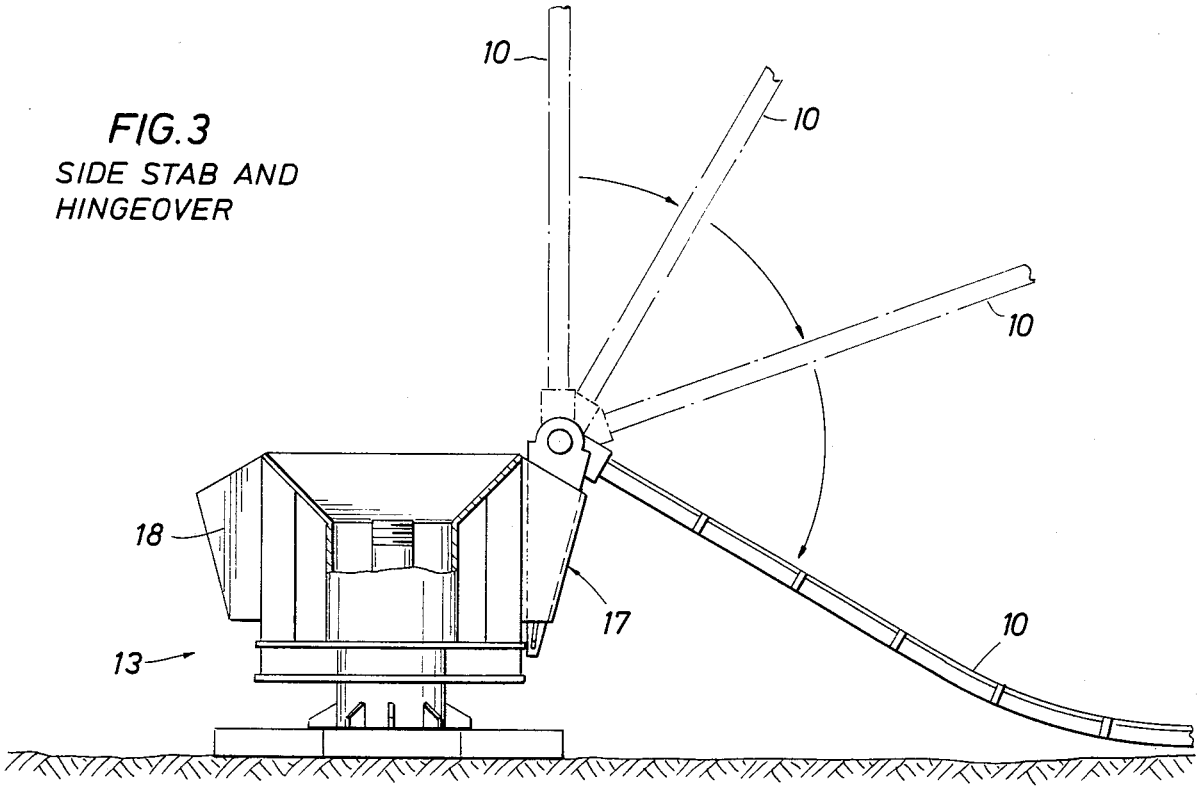
FIG. 3 discloses a second embodiment of the invention for making connection between the flowline and the subsea structure. This is the side stab and hingeover technique mentioned above.

FIG. 3 provides a second embodiment of a preferred apparatus wherein the flowline receiving means 17 is deployed to one side of the subsea structure. Otherwise, the process is essentially the same as shown in connection with the first embodiment of FIG. 2. A second flowline receiving means 18 is shown on the opposite side of the subsea structure and is available where a second flowline may be hinged-over and laid in the opposite direction to that of flowline 10. The second embodiment (side stab) of the flowline receiver causes more difficulty in landing the flowline connection tool than the first embodiment (center stab) since it provides a smaller landing area. On the other hand, the side stab embodiment enjoys an advantage over the center stab embodiment in not being centrally located and consequently not requiring removal prior to landing other equipment onto the subsea structure. Thus, the flowline connection tool and flowline receiving means may be left in place after the flowline connection and pipelaying operations are completed.

The foregoing description of the invention is merely intended to be explanatory thereof. Various changes in the details of the described method and apparatus may be made within the scope of the appended claims without departing from the spirit of the invention.

What is claimed is:

1. A method for vertically laying a flowline from a pipelay vessel to a subsea structure and then on sea bottom away from the subsea structure, comprising:

positioning the pipelay vessel above the subsea structure;

deploying the flowline vertically from the pipelay vessel to the subsea structure;

manipulating the flowline from the pipelay vessel to stab a flowline connection tool at the terminus of the flowline into a flowline receiver on the subsea structure, the flowline receiver having a funnel shape which mates with the shape of the flowline connection tool and which guides the flowline connection tool into the subsea structure;

hinging the flowline over from a vertical position to a horizontal position adjacent to the subsea structure; and vertically laying the flowline from the pipelay vessel on the seafloor away from the subsea structure.

2. The method of claim 1 wherein the flowline connection tool is stabbed into the flowline receiver centrally located on the subsea structure.

3. The method of claim 1 wherein the flowline connection tool is stabbed into the flowline receiver located on one side of the subsea structure.

4. An apparatus for vertically laying a flowline from a vessel to a subsea structure and then on the sea bottom away from the subsea structure, comprising:

means for positioning the pipelay vessel above the subsea structure;

means for deploying the flowline vertically from the pipelay vessel to the subsea structure;

means for manipulating the flowline from the pipelay vessel to stab a flowline connection tool at the terminus of the flowline into a flowline receiver on the subsea structure, the flowline receiver having a funnel shape which mates with the shape of the flowline connection tool and which guides the flowline connection tool into a hinged connection with the subsea structure;

means for hinging the flowline over from a vertical position to a horizontal position adjacent to the subsea structure; and means for vertically laying the flowline from the pipelay vessel on the seafloor away from the subsea structure.

5. The apparatus of claim 4 wherein the flowline receiver is centrally located on the subsea structure.

6. The apparatus of claim 4 wherein the flowline receiver is located on one side of the subsea structure.

* * * * *